US008909394B2

(12) United States Patent
Lundqvist et al.

(10) Patent No.: US 8,909,394 B2
(45) Date of Patent: Dec. 9, 2014

(54) METHOD FOR DETERMINING THREAT STATUS FOR COMBAT AIRCRAFTS

(75) Inventors: Anders Lundqvist, Vaxholm (SE); Vibeke Kensing, Vikingstad (SE)

(73) Assignee: SAAB AB, Linkoeping (SE)

( * ) Notice: Subject to any disclaimer, the term of this patent is extended or adjusted under 35 U.S.C. 154(b) by 0 days.

(21) Appl. No.: 14/352,280

(22) PCT Filed: Feb. 16, 2012

(86) PCT No.: PCT/SE2012/050168

§ 371 (c)(1), (2), (4) Date: Apr. 16, 2014

(87) PCT Pub. No.: WO2013/122521

PCT Pub. Date: Aug. 22, 2013

(65) Prior Publication Data

US 2014/0277852 A1 Sep. 18, 2014

(51) Int. Cl.
*G05D 1/00* (2006.01)
*F41G 3/22* (2006.01)

(52) U.S. Cl.
CPC ..... *F41G 3/22* (2013.01)
USPC ..... 701/5; 701/2

(58) Field of Classification Search
USPC ..... 701/3, 5
See application file for complete search history.

(56) References Cited

U.S. PATENT DOCUMENTS 4,947,350 A 8/1990 Murray et al.
5,635,662 A 6/1997 Robertson et al.
8,483,356 B2 * 7/2013 Bendahan ..... 378/57
2002/0088898 A1 * 7/2002 Lucy ..... 244/17.11
2005/0038628 A1 2/2005 Beuttel et al.
2005/0110661 A1 * 5/2005 Yannone et al. ..... 340/945

(Continued)

OTHER PUBLICATIONS

International Searching Authority, International Search Report and Written Opinion for International Application No. PCT/SE2012/050168, Nov. 8, 2012, 10 pages, Swedish Patent and Registration Office, Sweden.

(Continued)

*Primary Examiner* — Hussein A. Elchanti
(74) *Attorney, Agent, or Firm* — Alston & Bird LLP

(57) ABSTRACT

The invention relates to a method for decision support of a first combat aircraft (1) in a combat situation comprising the steps of: a) detecting (3) a second combat aircraft (2), wherein the second combat aircraft (2) is different from the first combat aircraft (1), b) analyzing (4) the second combat aircraft (2) to determine its type, its sensor capacity and its total weapons capacity, and c) recording (5) the sensor capacity and the total weapons capacity of the second combat aircraft (2) to determine a first geographic zone adapted for defining the detection limit of the second combat aircraft (2) and a second geographic zone adapted for defining a shoot-down limit of the second combat aircraft (2), respectively, wherein the first and the second geographic zone are adapted for decision support of the first combat aircraft (1) in the combat situation with the second combat aircraft (2). In this way, a possibility is provided to assist the pilot in decision support in complicated combat situations while being reliable, fast and easy to handle for the pilot in order to make a quick and efficient decision.

13 Claims, 1 Drawing Sheet

(56) References Cited

U.S. PATENT DOCUMENTS

| | | | | |
|---|---|---|---|---|
| 2005/0216181 | A1 | 9/2005 | Estkowski et al. | |
| 2005/0282527 | A1* | 12/2005 | Corman et al. | 455/414.1 |
| 2006/0290560 | A1* | 12/2006 | Bricker et al. | 342/20 |
| 2009/0182465 | A1* | 7/2009 | Wilke | 701/29 |
| 2010/0010793 | A1 | 1/2010 | Herman | |
| 2010/0156697 | A1* | 6/2010 | Yannone | 342/29 |
| 2010/0277345 | A1* | 11/2010 | Rodriguez et al. | 340/945 |
| 2011/0095933 | A1* | 4/2011 | Pevler et al. | 342/13 |
| 2014/0098937 | A1* | 4/2014 | Bendahan | 378/57 |

OTHER PUBLICATIONS

Saab Ab's Response to the International Searching Authority's Nov. 8, 2012, Written Opinion for International Application No. PCT/SE2012/050168, Dec. 13, 2013, 10 pages, Zacco Sweden AB, Sweden.

International Preliminary Examining Authority, International Preliminary Report on Patentability for International Application No. PCT/SE2012/050168, Jan. 15, 2014, 5 pages, Swedish Patent and Registration Office, Sweden.

* cited by examiner

METHOD FOR DETERMINING THREAT STATUS FOR COMBAT AIRCRAFTS

CROSS REFERENCE TO RELATED APPLICATIONS

This application is a national stage application, filed under 35 U.S.C. §371, of International Application No. PCT/SE2012/050168, filed Feb. 16, 2012, the contents of which are hereby incorporated by reference in its entirety.

BACKGROUND

1. Related Field

The invention relates to a method for decision support of a first combat aircraft in a combat situation.

2. Description of Related Art

Document U.S. Pat. No. 4,947,350 describes a tactical routing apparatus, for instance for an aircraft, which comprises stores for storing data representing the geographical domain through which the aircraft is to pass and data representing the location and type of a plurality of threats, and a processor for determining and displaying on a video display unit the optimal route connecting two points and the probability of successfully completing the route.

In combat aircrafts highly developed functions for human machine interface, HMI for short, and decision support exist and work as support functions for the pilot environment. These solutions are typically based on and adapted for high tempo in flight and combat situations where HMI and decision support together describe the current situation and display tools and solutions to the pilot. The solutions are usually based on the aircraft itself and its available resources and tools. Sensors, such as radar, are operated by the pilot as a tool for close-range scanning or for scanning objects for identification and continued pursuit. Typically, decision support supports the multiple use of sensors by merging objects detected by several different sensors and coordinating and correlating these objects in a situation picture. This is usually done via networks in further steps to create a common situation picture between several aircraft within an aircraft group.

When complexity increases because more tools and sensors are supplied, the possibilities available to the pilot to control his tools and/or sensors in time are limited and made difficult. In time-critical situations, for instance in air combat, the pilot risks becoming the underdog in combat. Another limitation is the fact that each tool and/or sensor has its own characteristics and peculiarities. Each sensor and/or tool thus requires its own interface and control functions which the pilot needs to be able to understand and use correctly.

BRIEF SUMMARY

It is the object of the invention to provide a possibility to assist a pilot in decision support in complicated combat situations while being reliable, fast and easy to handle for the pilot in order to make a quick and efficient decision.

This object is achieved by the subject matter of independent claim 1. Preferred embodiments are defined in the sub claims.

According to an aspect of the invention, this object is achieved by a method for decision support of a first combat aircraft in a combat situation comprising the steps of: a) detecting a second combat aircraft, wherein the second combat aircraft is different from the first combat aircraft, b) analyzing the second combat aircraft to determine its type, its sensor capacity and its total weapons capacity, and c) recording the sensor capacity and the total weapons capacity of the second combat aircraft to determine a first geographic zone adapted for defining the detection limit of the second combat aircraft and a second geographic zone adapted for defining a shoot-down limit of the second combat aircraft, respectively, wherein the first and the second geographic zone are adapted for decision support of the first combat aircraft in the combat situation with a second combat aircraft.

It is an idea of the invention to use information for a pilot or an unmanned aerial vehicle, UAV for short, in order to handle a complicated situation. Usually obstacles, such as hills, have an impact on the geographic zone. Furthermore, the geographic zone typically moves with the second combat aircraft. It is noted that the first geographic zone and the second geographic zone are independent from each other and that the first geographic zone refers to the sensors available and the second geographic zone refers to the weapons and/or fire control systems available.

According to a preferred embodiment of the invention, the second combat aircraft corresponds to at least one second combat aircraft arranged near the ground or on the ground and/or to another threat object which is arranged near the ground or on the ground, i.e. to a ground based threat, such as to a surface-to-air missile site, SAM for short. By adding a plurality of second combat aircrafts and/or by adding a plurality of ground based threats preferably a single geographic zone is integrated as the sum of the pluralities of the second combat aircrafts and/or the ground based threats. Preferably, by combining the SAM zone and the enemy aircraft zone, i.e., the aircraft zones of the second combat aircrafts, an integrated detection area and an integrated shoot-down area is obtained. Each enemy aircraft preferably comprises its own detection area. In case of a plurality of enemy aircrafts and/or a plurality of ground stations it preferably becomes possible to add their parts into a larger sum, i.e. to a larger detection area and/or to a longer range. The first combat aircraft preferably recognizes the larger sum as an integrated defence detection area. The plurality of enemy aircrafts preferably communicate their information between them such that when the first combat aircraft is detected and/or shot down by any of the enemy aircrafts the other enemy aircrafts become aware of this.

According to a preferred embodiment of the invention, the method comprises the step of storing the analyzed data in step b) and/or the recorded data in step c), wherein the recorded data is adapted for generating a situation picture. Preferably, the method comprises the step of displaying the analyzed data in step b) and/or the recorded data in step c). The step of displaying the recorded data in step c) preferably comprises displaying a plurality of situation pictures. The method preferably records the altitude of the first combat aircraft and/or of the second combat aircraft and displays the altitude together with the plurality of situation pictures such that a plurality of three dimensional plots results. The method preferably records time and displays the time together with a plurality of three dimensional plots such that a plurality of four dimensional plots results.

According to a preferred embodiment of the invention, the method further comprises the step of analyzing a flight regulated restriction and/or a landing zone approach requirement adapted for indicating a flight regulated area and/or a no-fly region. A flight regulated area preferably corresponds to a landing area or to a commercial flight "corridor". A no-fly region or no-fly zone preferably corresponds to a third country border.

The step of detecting is preferably performed by a sensor, such as radar, a database and/or a link. When the step of detecting is performed by a database this preferably corresponds to detecting by using a plurality of libraries for comparison purposes and when the step of detecting is performed by a link this preferably corresponds to an object, such as to a marine object, sending the required information to the first combat aircraft. Preferably, the first combat aircraft comprises a pilot's own aircraft and the second combat aircraft comprises an enemy aircraft and/or a ground based threat, such as a SAM, arranged near or on the ground or to a marine vessel. However, according to other preferred embodiments, also UAVs can be involved. Preferably, the second combat aircraft corresponds to an UAV. The ground based threat preferably corresponds to a SAM.

It is an idea of the invention to provide an HMI implementation which analyzes and summarizes the integrated ability of the enemy to detect and/or to destroy the pilot's own aircraft in a combat situation. All detected or assumed enemies with their assessed characteristics are summarized to form an integrated position evaluation. Their total sensor capacity is preferably recorded as a detection limit and the total weapons capacity preferably corresponds to a shoot-down limit or to a destroy limit. The invention thus serves for reducing the work load and stress level of the pilot before entering a combat situation. The pilot can then plan his entry into a detection zone more effectively and achieves a position of superiority before the subsequent duel. Thus the pilot can completely avoid approaching a shoot-down zone.

BRIEF DESCRIPTION OF THE FIGURES

These and other aspects of the invention will be apparent from and elucidated with reference to the embodiments described hereinafter.

In the drawings.

DETAILED DESCRIPTION OF VARIOUS EMBODIMENTS

Figure 1:
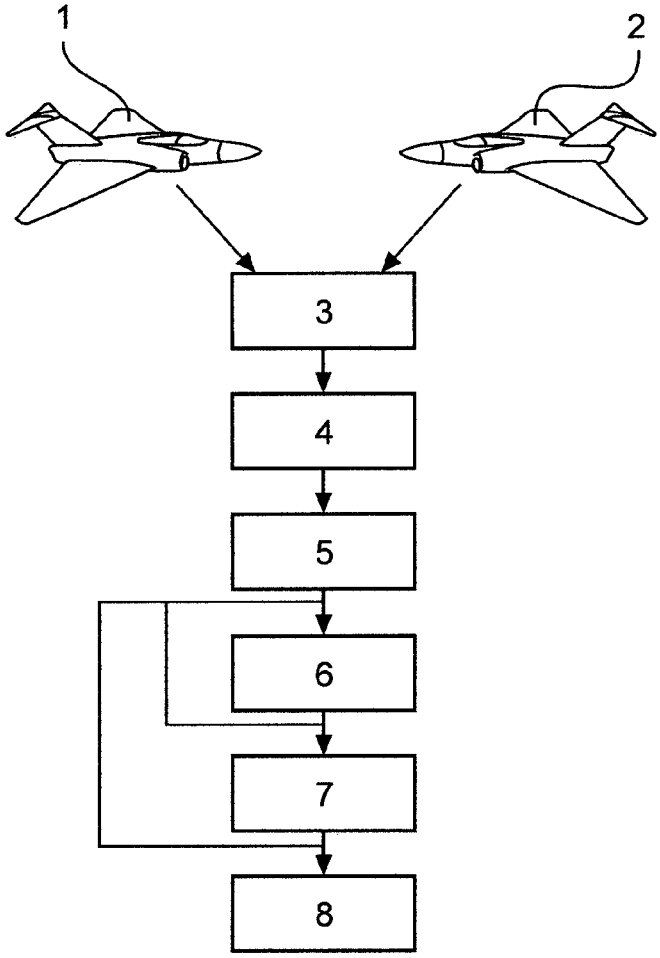
FIG. 1 illustrates the steps of a method for decision support of a first combat aircraft in a combat situation according to a preferred embodiment of the invention.

FIG. 1 illustrates the steps of a method for decision support of a first combat aircraft 1 in a combat situation according to a preferred embodiment of the invention. The method comprises the step of detecting 3 a second combat aircraft 2, wherein the second combat aircraft 2 is different from the first combat aircraft 1. In a second step, the second combat aircraft 2 is analyzed 4 in order to determine its type, its sensor capacity and its total weapons capacity. In a third step, the sensor capacity and the total weapons capacity of the second combat aircraft 2 is recorded 5 in order to determine a first geographic zone adapted for defining the detection limit of the second combat aircraft 2 and a second geographic zone adapted for defining a shoot-down limit of the second combat aircraft 2. In further steps, the method can comprise the step of storing 6 the analyzed data in step b) and/or the recorded data in step c). Further, the method can comprise the step of displaying 7 the analyzed data in step b) and/or the recorded data in step c). Moreover, the method can comprise the step of analyzing 8 a flight regulated restriction and/or a landing zone approach requirement adapted for indicating a flight regulated area and/or a no-fly region.

Figure 2:
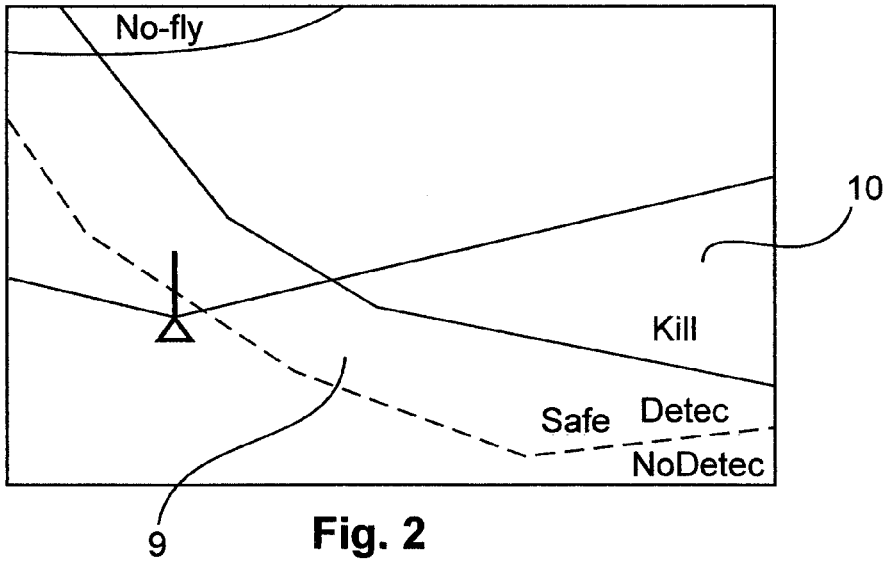
FIG. 2 illustrates the geographic zones integrated on the basis of the total capacity of the enemy according to another preferred embodiment of the invention.

FIG. 2 shows the geographic zones 9, 10 integrated on the basis of the total capacity of the enemy according to another preferred embodiment of the invention. Every detected or assumed enemy is type-classified. Typing enables an idea to be gained of the detectability of the sensor system of the enemy and also of the shoot-down capacity, i.e. the weapons system, of the enemy. All detected enemies are incorporated in the situation picture in the position perceived. The sensor limit range of the enemy or enemies involved are linked together by means of union such that a total sensor limit area can be illustrated to the pilot. The union of the sensor coverage forms the total detection area of the enemy framed by detection limit and corresponds to the first geographic zone 9. It is noted that the corresponding limit for the weapons range forms the shoot-down limit corresponding to the second geographic zone 10. Fixed limits of another type, for instance of a no-fly region and third party landing limits, are also incorporated in the HMI implementation according to this preferred embodiment of the invention.

It is an idea of the invention that before combat the pilot becomes able to prioritize his overview in the whole situation picture. Further, a more effective idea of the situation is given by means of an integrated situation picture for situations which do not contain a duel. The invention provides a possibility of being able to visualize decision support quickly and reliably relating to the risk based on being detected by the enemy aircraft or threat object and of being shot down.

While the invention has been illustrated and described in detail in the drawings and foregoing description, such illustration and description are to be considered illustrative or exemplary and not restrictive and it is not intended to limit the invention to the disclosed embodiments. The mere fact that certain measures are recited in mutually different dependent claims does not indicate that a combination of these measures cannot be used advantageously.

The invention claimed is:

1. A method for decision support of a first combat aircraft (1) in a combat situation comprising the steps of:

a) detecting (3) a second combat aircraft (2), wherein the second combat aircraft (2) is different from the first combat aircraft (1), b) analyzing (4) the second combat aircraft (2) to determine its type, its sensor capacity and its total weapons capacity, and c) recording (5) the sensor capacity and the total weapons capacity of the second combat aircraft (2) to determine a first geographic zone configured for defining the detection limit of the second combat aircraft (2) and a second geographic zone configured for defining a shoot-down limit of the second combat aircraft (2), respectively, wherein the first and the second geographic zone are configured for decision support of the first combat aircraft (1) in the combat situation with the second combat aircraft (2).

2. The method according to claim 1, further comprising the step of storing (6) at least one of the analyzed data in step b) or the recorded data in step c), wherein the recorded data is configured for generating a situation picture.

3. The method according to claim 1, further comprising the step of displaying (7) at least one of the analyzed data in step b) or the recorded data in step c).

4. The method according to claim 3, wherein the step of displaying (7) the recorded data in step c) comprises displaying a plurality of situation pictures.

5. The method according to claim 4, further comprising the steps of:

recording (5) at least one of the altitude of the first combat aircraft (1) or of the second combat aircraft (2); and displaying (7) the altitude together with the plurality of situation pictures such that a plurality of three dimensional plots results.

6. The method according to claim 5, further comprising the steps of recording (5) time and displaying (7) the time together with the plurality of three dimensional plots, such that a plurality of four dimensional plots results.

7. The method according to claim 1, further comprising the step of analyzing (8) at least one of a flight regulated restriction or a landing zone approach requirement configured for indicating at least one of a flight regulated area or a no-fly region.

8. The method according to claim 1, wherein the step of detecting (3) is performed by a sensor.

9. The method according to claim 8, wherein the sensor is at least one of a radar, a database, or a link.

10. The method according to claim 9, wherein:

when the step of detecting (3) is performed by a database, such detecting comprises detecting by using a plurality of libraries for comparison purposes; and when the step of detecting (3) is performed by a link, such comprises an object, such as to a marine object, sending the required information to the first combat aircraft (1).

11. The method according to claim 1, wherein:

the first combat aircraft (1) comprises a pilot's own aircraft; and the second combat aircraft (2) comprises at least one of an enemy aircraft or a ground based threat.

12. The method according to claim 11, wherein the second combat aircraft (2) is an unmanned aerial vehicle.

13. The method according to claim 11, wherein the ground based threat is a surface-to-air missile site.

* * * * *